US006378920B1

(12) United States Patent
Ostrowski et al.

(10) Patent No.: US 6,378,920 B1
(45) Date of Patent: Apr. 30, 2002

(54) DECK LID LATCH

(75) Inventors: Artur Jerzy Ostrowski, Rochester Hills; Hoi Wah Chow, Troy, both of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/474,957

(22) Filed: Dec. 30, 1999

(51) Int. Cl.[7] ..... E05C 3/06

(52) U.S. Cl. ..... 292/216; 292/DIG. 23; 292/DIG. 65

(58) Field of Search ..... 292/216, DIG. 23, 292/DIG. 43, DIG. 65

(56) References Cited

U.S. PATENT DOCUMENTS 4,917,420 A * 4/1990 Roger ..... 292/198
5,027,092 A * 6/1991 Castonguay et al. ..... 335/172
5,715,713 A * 2/1998 Aubry et al. ..... 70/277
5,738,393 A * 4/1998 Chao ..... 292/216
6,135,514 A * 10/2000 Kowalewski et al. ..... 292/216
6,247,732 B1 * 6/2001 Alton ..... 292/216

* cited by examiner

*Primary Examiner*—Chuck Y. Mah
*Assistant Examiner*—Mark Williams
(74) *Attorney, Agent, or Firm*—Kathryn A. Marra

(57) ABSTRACT

A vehicle closure has a deck lid latch that includes a disabling lever that is automatically engaged to disable the deck lid latch when the deck lid latch is unlatched. The disabling lever must be reset manually to restore normal latching operation of the deck lid latch. The disabling lever is reset manually by a control knob that is difficult to operate to avoid inadvertent resetting.

10 Claims, 6 Drawing Sheets

DECK LID LATCH

FIELD OF THE INVENTION

This invention relates generally to deck lid latches and more particularly to deck lid latches for closures that are unlatched exteriorly of the closure.

BACKGROUND OF THE INVENTION

Passenger vehicles are normally equipped with a rear vehicle compartment for storing a spare tire and transporting items such as groceries and luggage. The compartment, conventionally known as a trunk is closed by a deck lid that is hinged to the vehicle body and swings open to provide access to the compartment. The deck lid is equipped with a deck lid latch that cooperates with a striker attached to the vehicle body to latch the deck lid in the closed position automatically when the deck lid is closed. The closed deck lid is opened after the deck lid latch is unlatched, either manually or electrically from a position outside the rear vehicle compartment. Automatic latching of the deck lid latch upon closure of the deck lid may result in an unintentional latching of the deck lid without any readily available means of unlatching the deck lid latch after the deck lid is closed.

SUMMARY OF THE INVENTION

The object of the invention is to provide a deck lid latch that does not automatically latch when deck lid is closed.

A feature of the invention is that the deck lid latch is equipped with a disabling device that disables the detent lever of the deck lid latch when the deck lid latch is unlatched thus preventing an inadvertent automatic latching of the deck lid latch when the deck lid is closed subsequently.

Another feature of the invention is that the deck lid latch is equipped with a disabling device that must be reset manually after the deck lid latch is unlatched in order to arm the deck lid latch for a subsequent latching operation.

Another feature of the invention is that the deck lid latch is equipped with a disabling device that is automatically engaged but difficult to disengage.

Still another feature of the invention is that the deck lid latch is equipped with a disabling device that disables the lever detent in response to an unlatching operation.

These and other objects, features and advantages of the invention will become more apparent from the following description of a preferred embodiment taken in conjunction with the accompanying drawing.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 1:
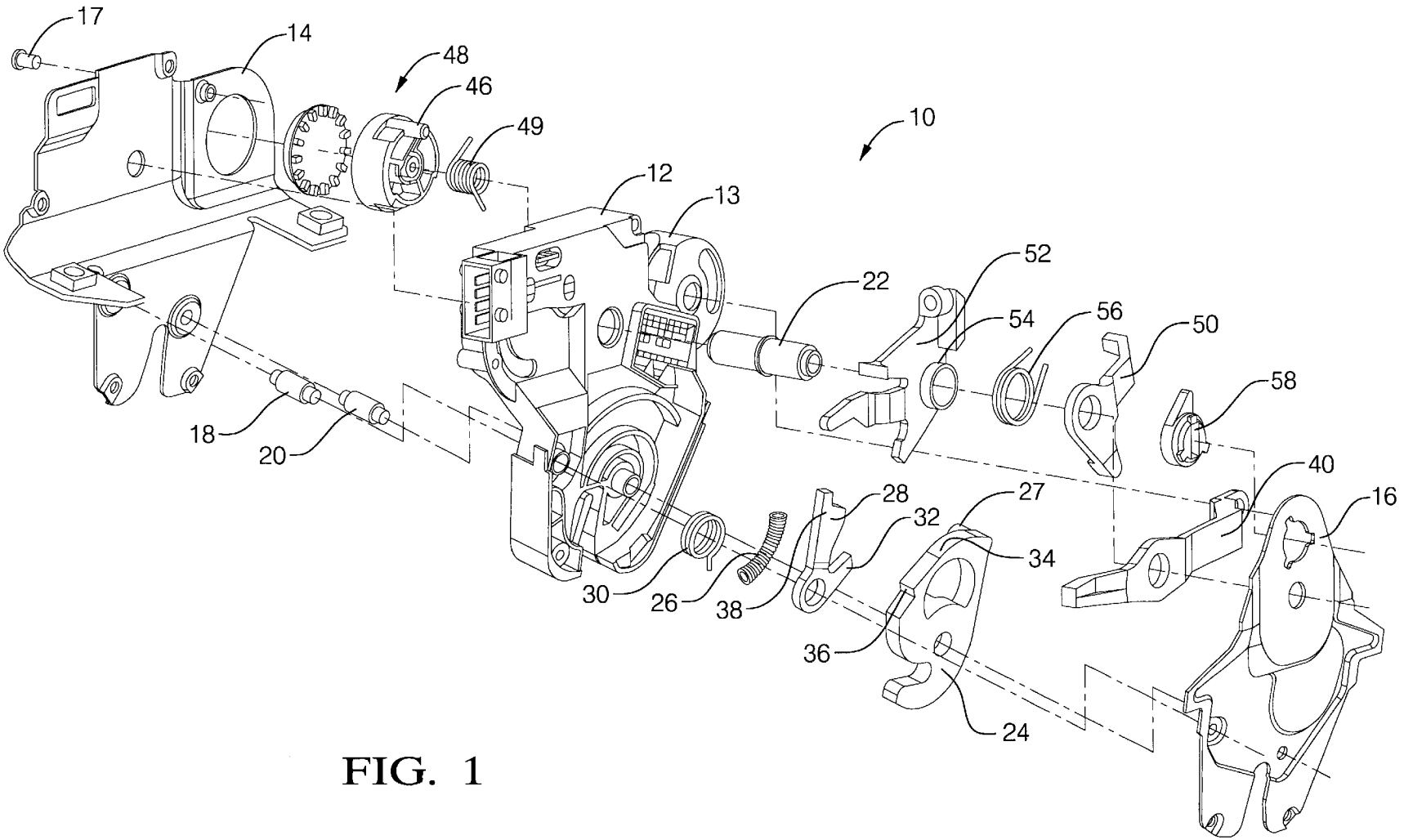
FIG. 1 is an exploded perspective view of a deck lid latch of the invention.

Deck lid latch 10 comprises a plastic housing 12, a steel frame 14 and a steel face plate 16 that are secured together by four rivets, one of which is indicated at 17, to form a housing assembly that is adapted for fastening to a deck lid of a rear vehicle compartment, such as a trunk (not shown). The housing assembly contains three pivot pins 18, 20 and 22 that are supported at opposite ends by frame 14 and face plate 16 and a fork bolt 24 that pivots on pivot pin 20 between an open or unlatched position shown in FIG. 2 and a closed or latched position shown in FIGS. 3 and 7. Deck lid latch 10 is attached to the deck lid (not shown) with face plate 16 against an inside surface of the deck lid so that fork bolt 24 is moved from the open position shown in FIG. 2 to the closed position shown in FIG. 7 when the deck lid is closed and fork bolt 24 engages a striker that is attached to the vehicle body at the deck lid opening. The striker is shown schematically at 25 in FIGS. 3 and 7. The cooperation of a fork bolt and striker is well known and need not be described in detail.

Figure 2:
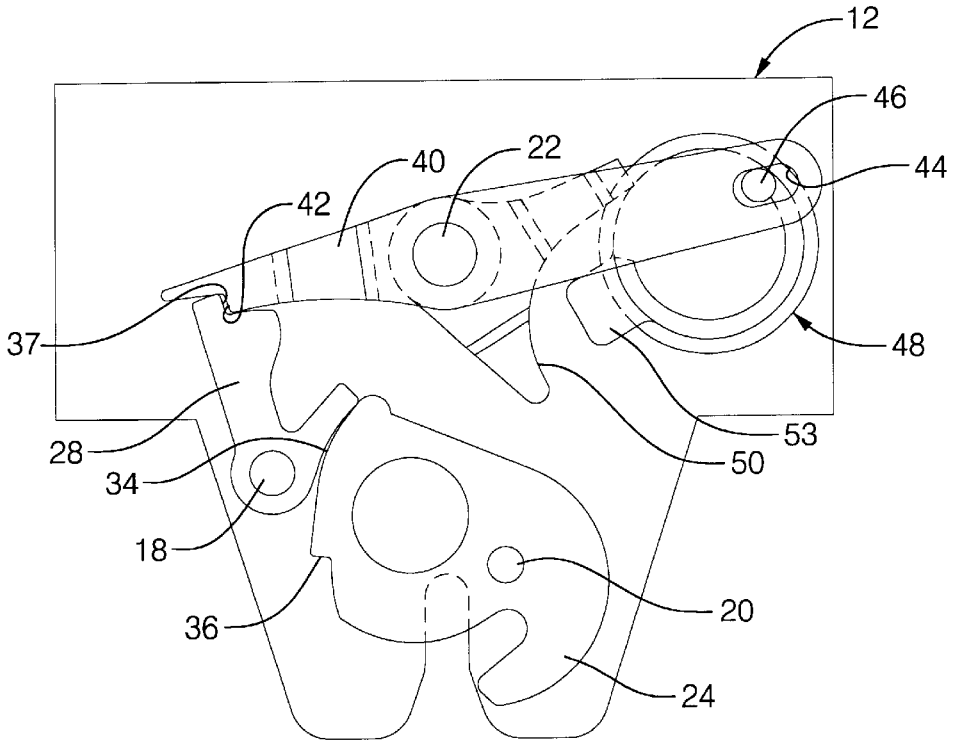
FIG. 2 is a fragmentary front view of the deck lid latch of FIG. 1 showing various parts of the latch in the open or unlatched position with the disabling device engaged.
Figure 3:
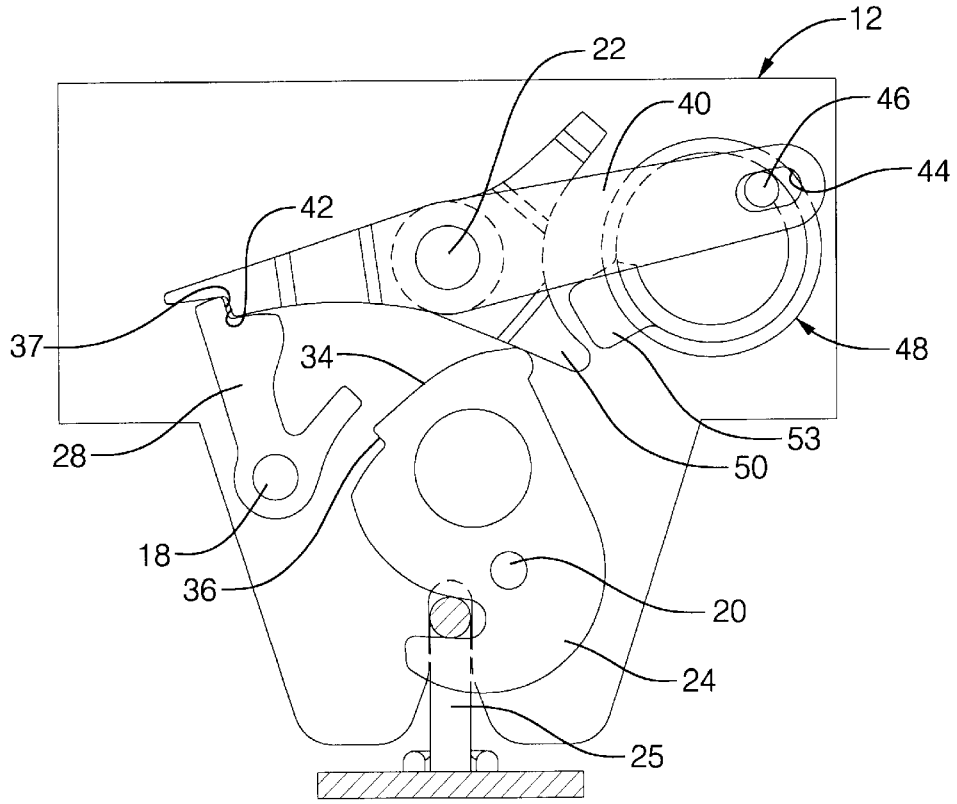
FIG. 3 is a fragmentary front view of the deck lid latch of FIG. 1 showing various parts of the latch in the closed or latched position with the disabling device engaged.
Figure 7:
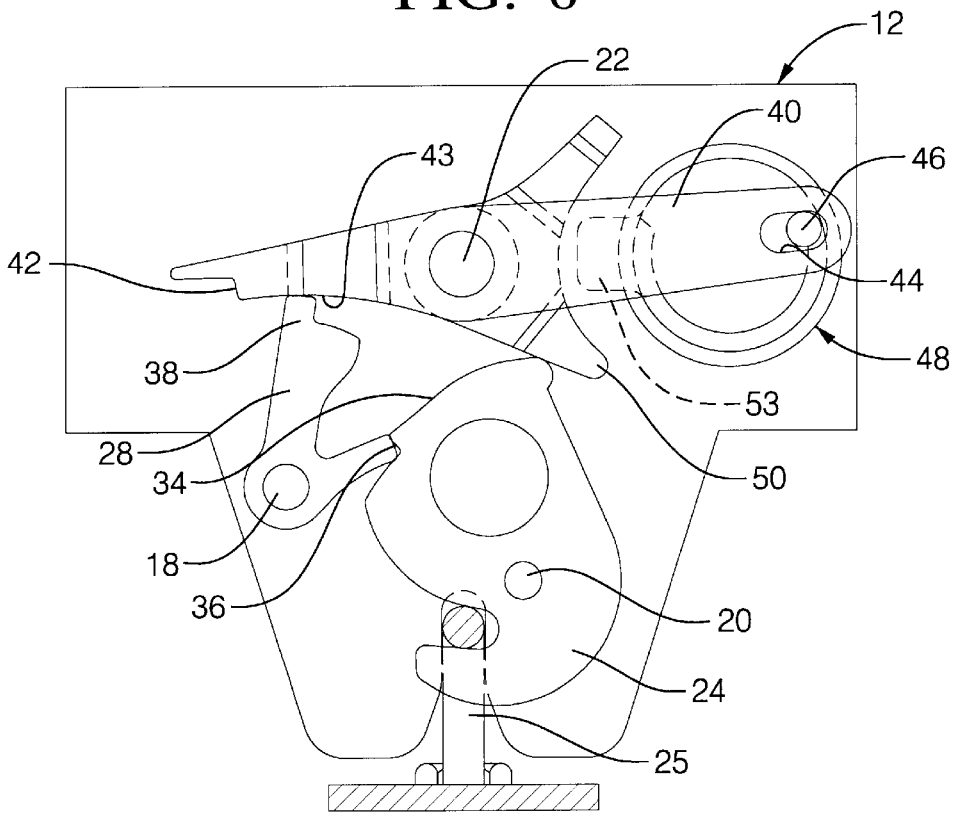
FIG. 7 is a fragmentary front view of the deck lid latch of FIG. 1 showing various parts of the latch in the closed or latched position with the disabling device disengaged.

Deck lid latch 10 further comprises a detent lever 28 that pivots on pivot pin 18 and cooperates with fork bolt 24 in a well known manner to retain fork bolt 24 in the closed position shown in FIG. 7 or release the fork bolt 24 for return to the open position shown in FIG. 2. That is, detent lever 28 pivots between a detent position shown in FIG. 7 and a release position shown in FIG. 2. Fork bolt 24 is spring biased counterclockwise to the open position shown in FIG. 2 by a coil spring 26 (FIG. 1) that is disposed in a chamber of housing 12 engaging housing 12 at one end and protuberance 27 of fork bolt 24 at the other end. Detent lever 28 is spring biased clockwise by a coil spring 30 (FIG. 1) that surrounds pivot pin 18 with an extension at one end engaging housing 12 and an extension at the other end engaging detent lever 28 so that arm 32 of detent lever 28 rides over cam end 34 of fork bolt 24 and engages latch shoulder 36 of fork bolt 24 when fork bolt 24 is moved to the closed position by closing the deck lid as shown in FIG. 7.

Detent lever 28 has an upper arm 38 that cooperates with a disabling lever 40 that pivots on pivot pin 22. Disabling lever 40 has a catch 42 at one end that engages notch 37 of upper arm 38 and holds detent lever 28 in the release position when disabling lever 40 is in an engaged position as shown in FIG. 2. Disabling lever 40 has a slot 44 at the other end that is engaged by pin 46 of a rotary control knob 48. Control knob 48 rotates in a compartment 13 of housing 12 with pin 46 extending through a slot as shown in FIG. 1. A coil return spring 49 in compartment 13 biases control knob 48 counterclockwise to the engaged position shown in FIG. 2.

Latch 10 further comprises a reset lever 50 that pivots on pivot pin 22 behind disabling lever 40 and a release lever 52 that pivots on pivot pin 22 behind reset lever 50. Release lever 52 has a collar 54 that supports a coil return spring 56 that biases reset lever 50 clockwise into engagement with control knob 48. Release lever 52 is operated by a conventional key lock cylinder 58 to move detent lever 28 to the release position allowing the deck lid to open as explained below in connection with FIGS. 2–11. (Springs 26, 30, 56 and release lever 52 have been omitted in FIGS. 2–8 for clarity.)

Latch 10 operates as follows. Referring first to FIG. 2, various parts of the latch 10 are shown when the fork bolt 24 is in the open or unlatched position with the disabling lever 40 engaged. In this condition, detent 28 is held in the release position by disabling lever 40. When the deck lid supporting latch 10 is closed, fork bolt 24 in a normal manner. However, the deck lid is not latched because the detent 28 is held in the release position by disabling lever 40 and fork bolt 24 is thus free to pivot counterclockwise back to the release position shown in FIG. 2. Hence the deck lid can be opened easily exteriorly or interiorly.

In order to latch the deck lid, disabling lever 40 must be disengaged. This is accomplished by turning the knob 48 about an ⅛ turn clockwise to a disengaged position which pivots disabling lever 40 clockwise to a disengaged position shown in FIG. 4 where catch 42 is raised above the path of travel of detent 28. Control knob 48 is held in the disengaged position by reset lever 50. Control knob 48 preferably includes a stop tab 53 that engages a set screw 55 when control knob 48 reaches the disengaged position so that the control knob 48 can be operated blindly. (Control knob 48 itself, may also have a control feature to make the ⅛ turn difficult as explained below.) Thus when the deck lid is closed with the disabling lever 40 disengaged, detent 28 rides over cam end 34, and engages latch shoulder 36 to hold fork bolt 24 in the latched position as shown in FIG. 7.

Figure 5:
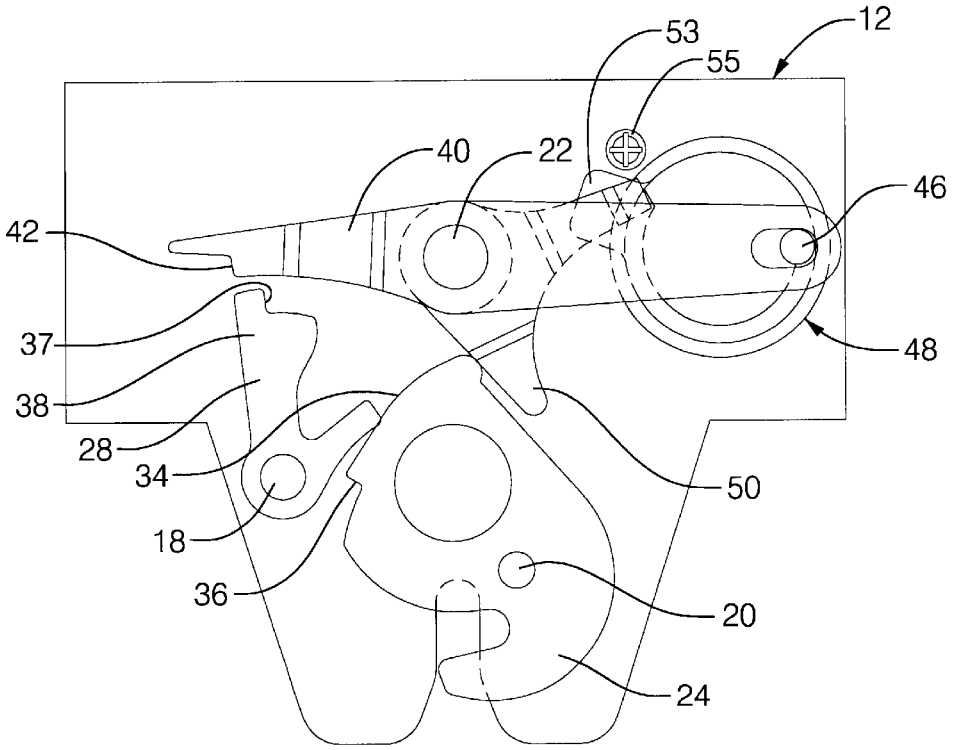
FIG. 5 is a fragmentary front view of the deck lid latch of FIG. 1 showing various parts of the latch in an intermediate position with the disabling device disengaged.
Figure 6:
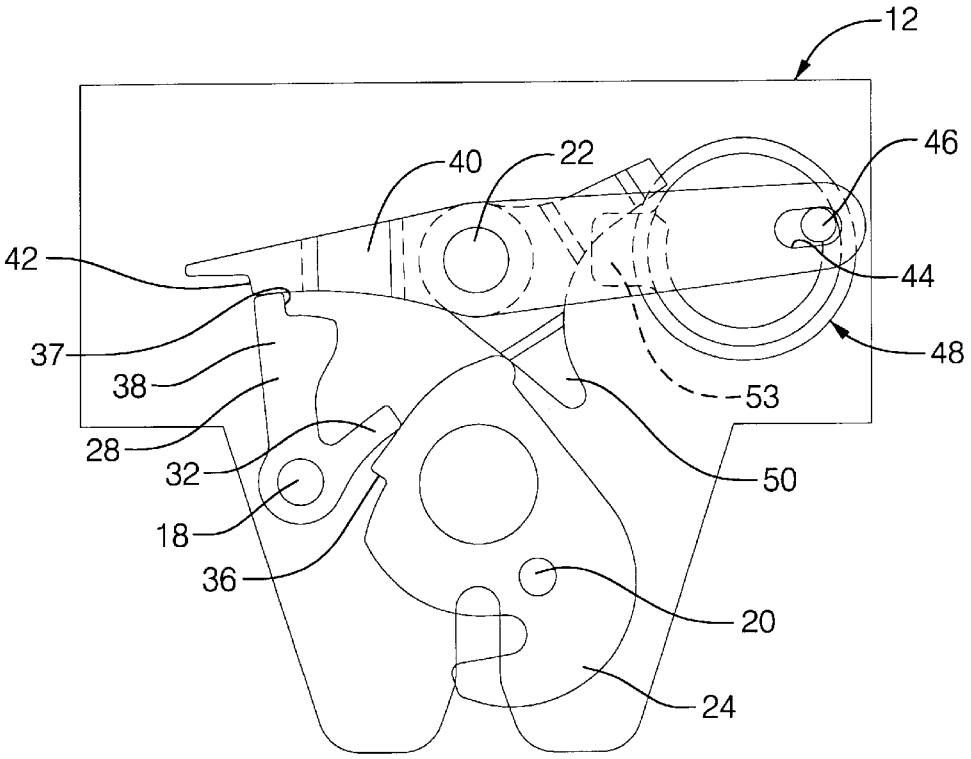
FIG. 6 is a fragmentary front view of the deck lid latch of FIG. 1 showing various parts of the latch in a subsequent intermediate position with the disabling device disengaged.

Closure of the deck lid also resets disabling lever 40 partially. More particularly, as fork bolt 24 pivots clockwise to the latched position, cam end 34 also engages reset lever 50 as shown in FIG. 5. Further clockwise movement of fork bolt 24 pivots reset lever 50 counter clockwise releasing control knob 48 and disabling lever 40 so that disabling lever 40 falls down onto upper arm 38 of detent 28 as shown in FIG. 6. However, catch 42 has been passed by the cooperating notch 37 of detent 28 so that detent 28 just slides along surface 43 of disabling lever 40 until the lower arm 32 of detent 32 engages latch shoulder 36 of fork bolt 24 to hold fork bolt 24 in the latched position as shown in FIG. 7.

The deck lid is reopened by unlatching latch 10 in a conventional manner, for instance manually with a key lock cylinder 58 which is pivoted clockwise as shown in FIG. 1 engaging and pivoting release lever 52 clockwise; release lever 52 in turn engaging and pivoting detent lever 28 counterclockwise to the release fork bolt 24. Fork bolt 24 is now free to pivot counterclockwise to the unlatched position shown in FIG. 2.

The unlatching operation completes the resetting of the disabling lever 40. More particularly, as fork bolt 24 pivots counterclockwise from the latched position shown in FIG. 7 to the unlatched position shown in FIG. 2, disabling lever 40 is pivoted clockwise by control knob 48 and spring 49 until catch 42 engages notch 37 of detent lever 28. Reset lever 50 is also released from cam end 34 and pivots clockwise into engagement with knob 48. Thus the disabling lever 40 is automatically engaged with the detent lever 28 when the trunk lid is opened. The trunk lid then cannot be latched closed again until the disabling lever 40 is disengaged by turning control knob 48 as explained above.

Figure 4:
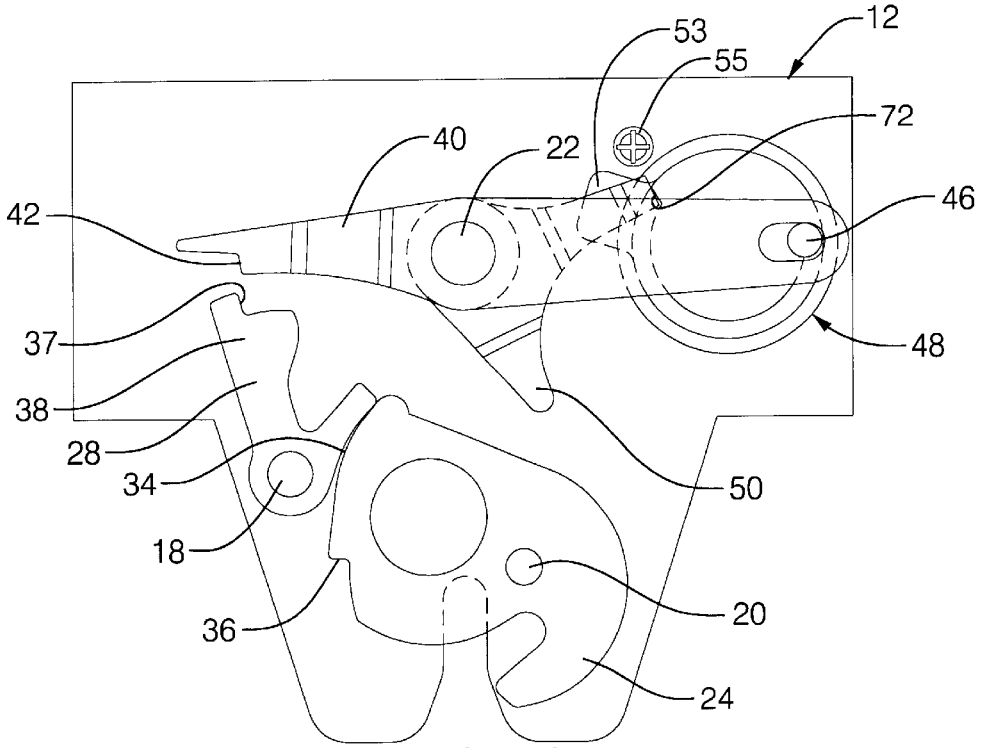
FIG. 4 is a fragmentary front view of the deck lid latch of FIG. 1 showing various parts of the latch in the open or unlatched position with the disabling device disengaged.
Figure 8:
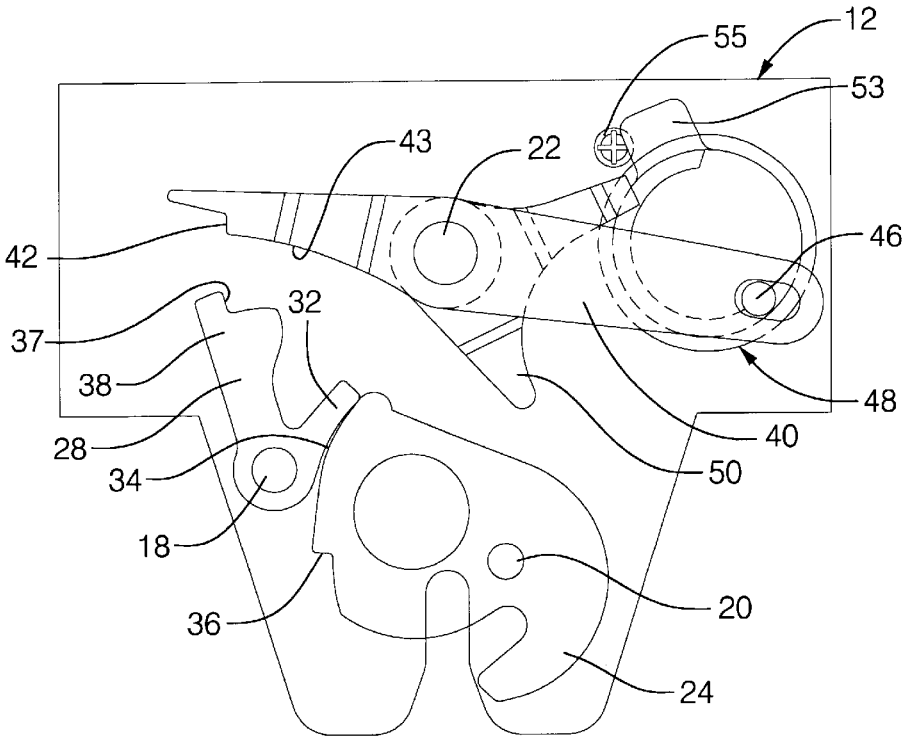
FIG. 8 is a fragmentary front view of the deck lid latch of FIG. 1 showing various parts of the latch in the open or unlatched position with the disabling device disabled.

Disabling lever 40 can be disabled or locked out by removing set screw 55, turning knob 48 approximately a ¼ turn in the clockwise direction (past the disengaged position) and reinstalling set screw 55 as shown in FIG. 8. The optional set screw 55 is shown in FIGS. 4, 5 and 8 but has been omitted in FIGS. 1, 2, 3, 6 and 7 for clarity.

Figure 9:
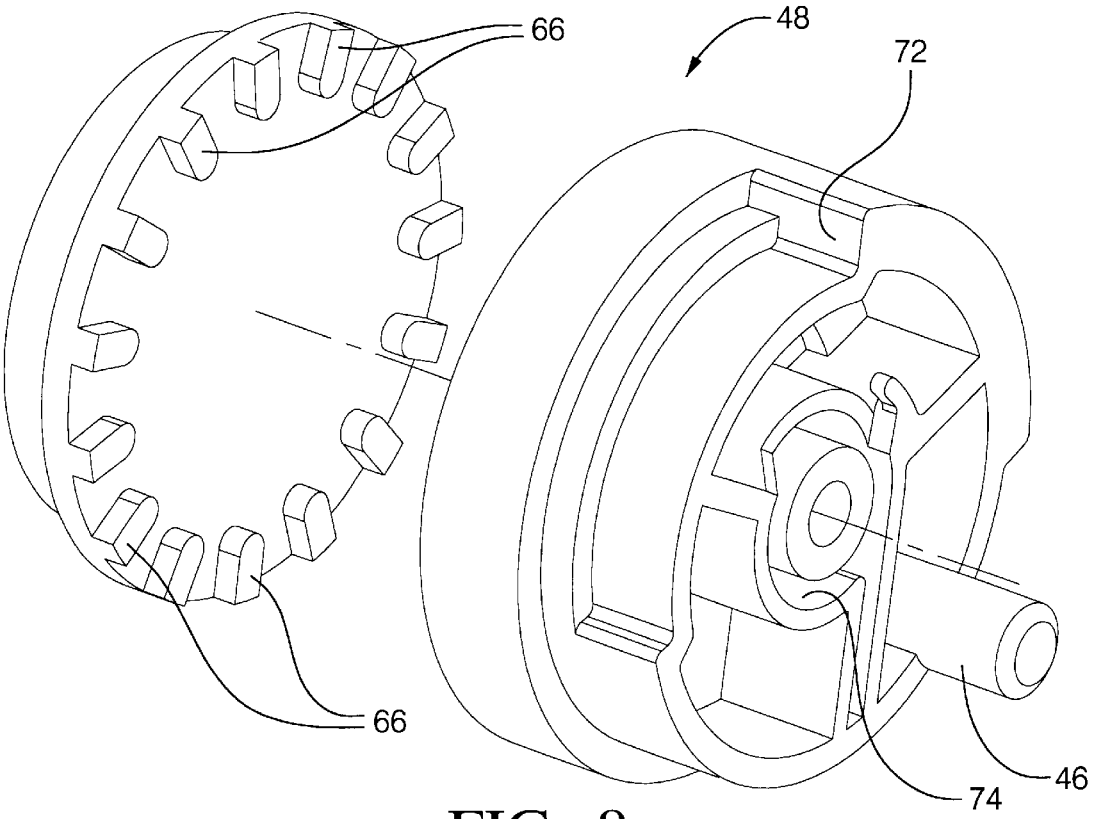
FIG. 9 is an exploded perspective view of the knob shown in FIG. 1.
Figure 10:
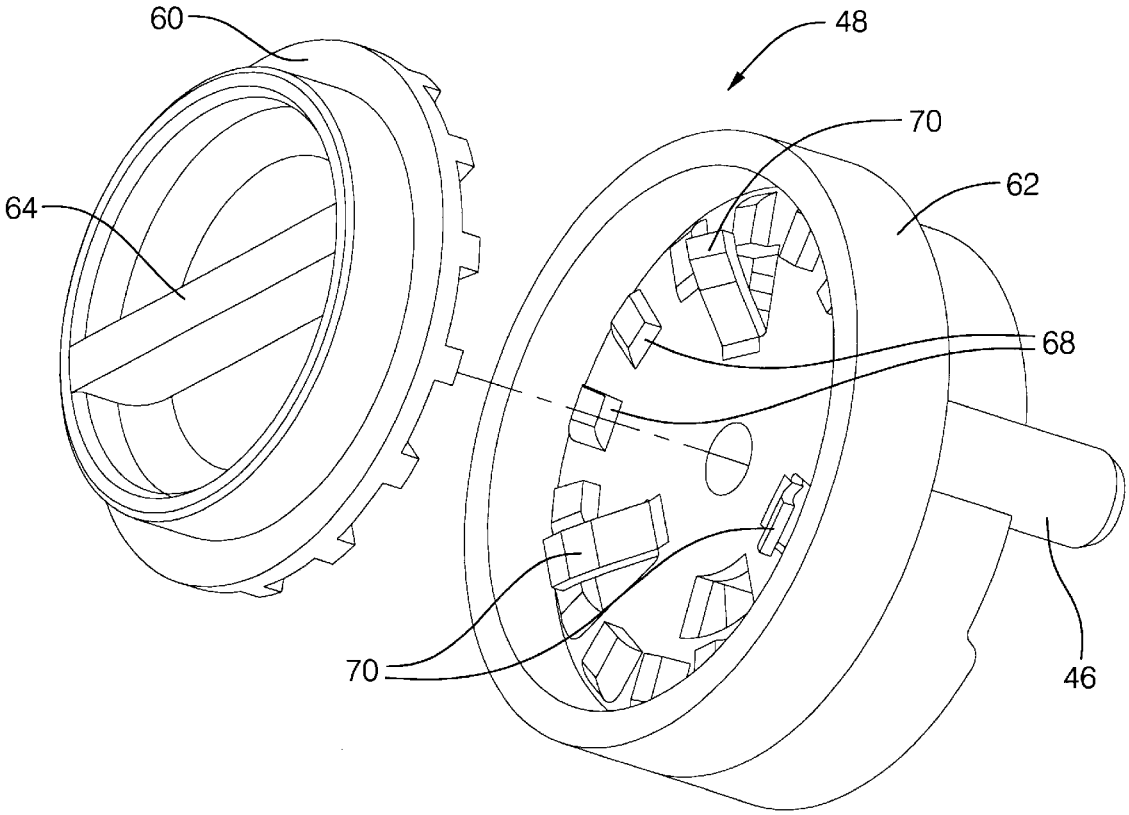
FIG. 10 is an exploded rear perspective view of the knob.

Control knob 48 itself preferably includes a control feature that will now be explained in conjunction with FIGS. 9, 10 and 11. FIG. 9 is a exploded perspective view of control knob 48. FIG. 10 is an exploded perspective rear view of control knob 48 and FIG. 11 is a section of control knob 48.

Control knob 48 comprises an input member 60 that rotates in a rear chamber of an output member 62 which rotates in housing compartment 13 against the bias of spring 49 as described above. Input member 60 has an exterior handle 64 and a plurality of circumferentially spaced lugs 66 disposed in the rear chamber of output member 62. Output member 62 also has a plurality of circumferentially spaced lugs 68 and three equally spaced radial spring fingers 70.

Figure 11:
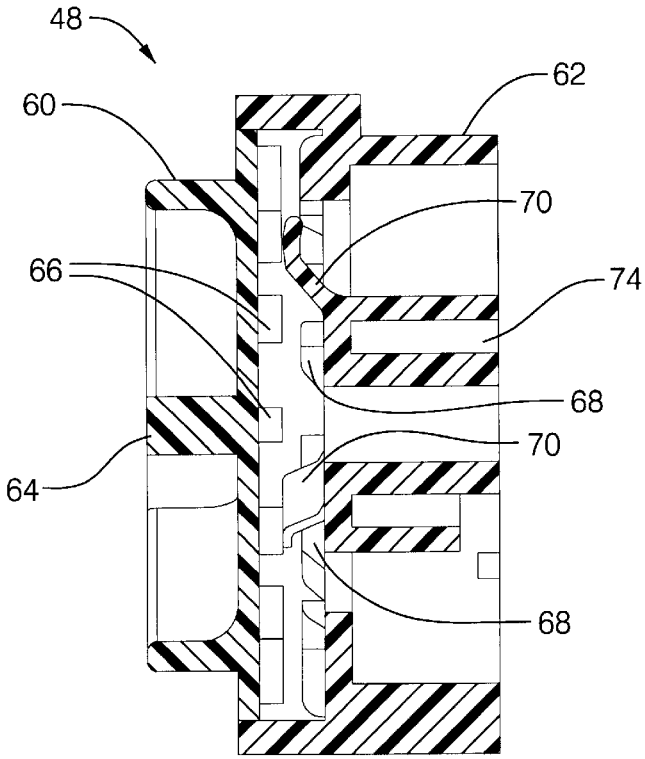
FIG. 11 is a vertical section of the knob.

Input member 60 is rotably retained in the rear chamber of output member 62 by any suitable means and engaged by spring fingers 70 to keep lugs 66 spaced from lugs 68 as best shown in FIG. 11. Output member 62 rotates in housing compartment 13 and includes pin 46 that extends through a housing slot for engagement with slot 44 of release lever 40 as shown in FIG. 1 and as indicated above. Output member 62 further includes an external stop shoulder 72 that cooperates with reset lever 50; an external chamber 74 for return spring 49; and may include the optional stop tab 53 that is shown in FIGS. 8–10.

Control knob 46 operates as follows to disengage disabling lever 40. Input member 60 is pushed into the rear chamber of output member 62 until lugs 64 fit between lugs 68 and then turned ⅛ turn clockwise turning output member 62 clockwise until reset lever 50 engages stop shoulder 72 as shown in FIG. 4 whereupon input member 60 is released. This disengages disabling lever 40 so that the deck lid can be closed and latched in the closed position as shown in FIG. 7. Disabling lever 40 is then automatically reengaged when fork bolt 24 is moved to the unlatched position when the deck lid is opened as shown is FIG. 2. Control knob 48 is operated in like manner to turn output member 62 to the lock-out position shown in FIG. 8 where the lock lever 40 is disabled by set screw 55 engaging the remote side of stop tab 53 to prevent return of the control knob 46 to the engaged position.

While the compartment latch of our invention has been described in connection with deck lid 11, the compartment latch can be used with other compartment closures where unintentional latching is not desirable. In other words, many modifications and variations of the present invention in light of the above teachings may be made. It is, therefore, to be understood that, within the scope of the appended claims, the invention may be practiced otherwise than as specifically described.

We claim:

1. A deck lid latch comprising:

a housing that is adapted for fastening to a closure, a fork bolt that moves between an open position and a closed position, a detent lever that moves between a detent position and a release position, the detent lever retaining the fork bolt in the closed position when in the detent position and releasing the fork bolt for return to the open position when in the release position, a disabling lever that pivots between an engaged position and a disengaged position, the disabling lever holding the detent lever in the release position when in the engaged position and allowing the detent lever to return to the detent position when in the disengaged position, and a reset lever that holds the disabling lever in the disengaged position, the reset lever being engaged and moved by the fork bolt to release the disabling lever when the fork bolt moves from the open position to the closed position.

2. The deck lid latch as defined in claim 1 wherein the disabling lever pivots on a pivot pin and the reset lever pivots on the pivot pin.

3. The deck lid latch as defined in claim 2 wherein the disabling lever has a catch at one end that engages a notch in the detent lever to hold the detent lever in the release position.

4. A deck lid latch comprising:

a housing that is adapted for fastening to a closure, a fork bolt that moves between an open position and a closed position, a detent lever that moves between a detent position and a release position, the detent lever retaining the fork bolt in the closed position when in the detent position and releasing the fork bolt for return to the open position when in the release position, a disabling lever that pivots between an engaged position and a disengaged position, the disabling lever holding the detent lever in the release position when in the engaged position and allowing the detent lever to return to the detent position when in the disengaged position, a reset lever that holds the disabling lever in the disengaged position, the reset lever being engaged and moved by the fork bolt to release the disabling lever when the fork bolt moves from the open position to the closed position, the disabling lever pivoting on a pivot pin and the reset lever pivoting on the pivot pin, and a rotary control knob, the disabling lever having an opposite end operatively engaging the control knob.

5. The vehicle closure latch as defined in claim 4 wherein the rotary control knob has an engaged position and a disengaged position, the control knob holding the disabling lever in the engaged position when the control knob is in the engaged position and holding the disabling lever in the release position when the control knob is in the disengaged position.

6. A deck lid latch comprising:

a housing that is adapted for fastening to a closure, a fork bolt that moves between an open position and a closed position, a detent lever that moves between a detent position and a release position, the detent lever retaining the fork bolt in the closed position when in the detent position and releasing the fork bolt for return to the open position when in the release position, a disabling lever that pivots on a pivot pin between an engaged position and a disengaged position, the disabling lever having a catch at one end holding the detent lever in the release position when the disabling lever is in the engaged position and allowing the detent lever to return to the detent position when the disabling lever is in the disengaged position, a rotary control knob connected to an opposite end of the disabling lever, the rotary control knob having an engaged position where the control knob holds the disabling lever in the engaged position, and the control knob having a disengaged position where the control knob holds the disabling lever in the disengaged position, and a reset lever that holds the control knob in the disengaged position and that is engaged and moved by the fork bolt to release the control knob when the fork bolt moves from the open position to the closed position.

7. The deck lid latch as defined in claim 6 wherein the reset lever pivots on the pivot pin for the disabling lever.

8. The deck lid latch as defined in claim 6 wherein the control knob is connected to the opposite end of the disabling lever by a pin and slot arrangement.

9. The deck lid latch as defined in claim 6 wherein the rotary control knob has an input member and an output member, the input member having lugs that engage lugs of the output member to rotate the output member, and one of the input member and the output member having springs engaging another of the input member and the output member to space the lugs of the input member from the lugs of the output member so that the input member free wheels with respect to the output member.

10. The deck lid latch as defined in claim 9 wherein the output member has a pin that engages in a slot at the opposite end of the disabling lever.

* * * * *